US007600990B2

(12) United States Patent
Chang et al.

(10) Patent No.: US 7,600,990 B2
(45) Date of Patent: Oct. 13, 2009

(54) ELECTROSTATIC SPINNING APPARATUS

(75) Inventors: Haw-Jer Chang, Hsinchuang (TW); Jen-Hsiung Lee, Panchiao (TW)

(73) Assignee: Taiwan Textile Research Institute, Taipei Hsien (TW)

( * ) Notice: Subject to any disclaimer, the term of this patent is extended or adjusted under 35 U.S.C. 154(b) by 453 days.

(21) Appl. No.: 11/647,502

(22) Filed: Dec. 28, 2006

(65) Prior Publication Data

US 2008/0150197 A1 Jun. 26, 2008

(30) Foreign Application Priority Data

Dec. 21, 2006 (TW) ..... 95148204 A

(51) Int. Cl.
*D01D 5/00* (2006.01)

(52) U.S. Cl. ..... 425/83.1; 264/441; 264/465; 425/174.8 E

(58) Field of Classification Search ..... 425/83.1, 425/174.8 E; 264/441, 465
See application file for complete search history.

(56) References Cited

U.S. PATENT DOCUMENTS 4,069,026 A * 1/1978 Simm et al. ..... 95/63
4,143,196 A * 3/1979 Simm et al. ..... 428/212
4,230,650 A * 10/1980 Guignard ..... 264/441
2009/0127747 A1 * 5/2009 Green et al. ..... 264/413
2009/0148547 A1 * 6/2009 Petras et al. ..... 425/174.8 E

FOREIGN PATENT DOCUMENTS

WO WO 2005/024101 3/2005

* cited by examiner

*Primary Examiner*—Robert B Davis
*Assistant Examiner*—Joseph Leyson
(74) *Attorney, Agent, or Firm*—Knobbe Martens Olson & Bear LLP

(57) ABSTRACT

An electrostatic spinning apparatus includes a feeding device, at least one linear electrode, at least one collecting electrode, and a high-voltage power supply. The feeding device includes a tank and a roller and an electrostatic spinning solution is contained in the tank. The roller is rolled in the tank. The linear electrode is contact with the roller to absorb the electrostatic spinning solution onto the linear electrode. The collecting electrode is disposed equidistantly to the linear electrode. The high-voltage power supply is connected with the linear electrode and the collecting electrode to opposite charge the linear electrode and the collecting electrode. The electrostatic spinning solution is guided to the collecting electrode from linear electrode and formed an electrostatic spinning fiber.

30 Claims, 6 Drawing Sheets

ELECTROSTATIC SPINNING APPARATUS

RELATED APPLICATIONS

This application claims priority to Taiwan Application Serial Number 95148204, filed Dec. 12, 2006, which is herein incorporated by reference.

BACKGROUND

1. Field of Invention

The present invention relates to an electrostatic spinning apparatus. More particularly, the present invention relates to an electrostatic spinning apparatus for mass production.

2. Description of Related Art

Electrostatic spinning technology can be used for manufacturing nanofibers. The principle of electrostatic spinning technology is to provide a driving force generated by an electric field between a positive electrode and a negative electrode, so as to overcome surface tension and viscosity of the polymeric electrostatic spinning solution. In addition, fibers made by electrostatic spinning solution and spun from a spinneret repel each other because they are like-charged; when solvent evaporates, ultra-thin fibers can be formed. Comparing to the fibers produced by prior spinning technology, the fabric made by electrostatic spinning method is featured by several properties, such as higher porosity, larger surface area, and smaller pore size than those of conventional fabrics.

The charged electrostatic spinning solution is spun to a collecting electrode from the spinneret. However, the aperture of the spinneret is very small and is easily blocked up by residual solution inside the spinneret. Moreover, the spinneret and pipe need to be cleaned when changing electrostatic spinning solution. The applicability of the electrostatic spinning technique and the diversity of electrostatic spinning solutions are thus reduced.

WO patent 2005/024101A1 provides a roller as a high voltage electrode to spin the electrostatic spinning solution without the spinneret. The roller in a solution tank needs to be machined to form a raised portion on the surface of the roller. The electrostatic spinning solution is departed from the raised portion of the roller and formed the electrostatic spinning fibers on the collecting electrode. The method requires an additional process of machining roller surface, so the cost of the electrostatic spinning apparatus is increased.

SUMMARY

The invention provides an electrostatic spinning apparatus includes a feeding device, at least one linear electrode, at least one collecting electrode, and a high-voltage power supply. The feeding device includes a tank for containing electrostatic spinning solution and a roller. The roller is rolled in the tank. The linear electrode is contacted with the roller to absorb the electrostatic spinning solution onto the linear electrode. The collecting electrode is disposed equidistantly to the linear electrode. The high-voltage power supply is connected with the linear electrode and the collecting electrode to oppositely charge the linear electrode and the collecting electrode. The electrostatic spinning solution is led to the collecting electrode from linear electrode and formed an electrostatic spinning fiber.

The invention also provides an electrostatic spinning apparatus includes a tank to contain an electrostatic spinning solution, a plurality of rollers rolled in the tank, a plurality of linear electrodes, each of the linear electrodes is contacted and paired with one of the rollers to coat the electrostatic spinning solution onto the linear electrodes, at least one collecting electrode disposed equidistantly to the linear electrodes; and a high-voltage power supply is connected with the linear electrodes and the collecting electrode to oppositely charge the linear electrodes and the collecting electrode. The electrostatic spinning solution may be led to the collecting electrode from the linear electrodes and formed an electrostatic spinning fiber.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
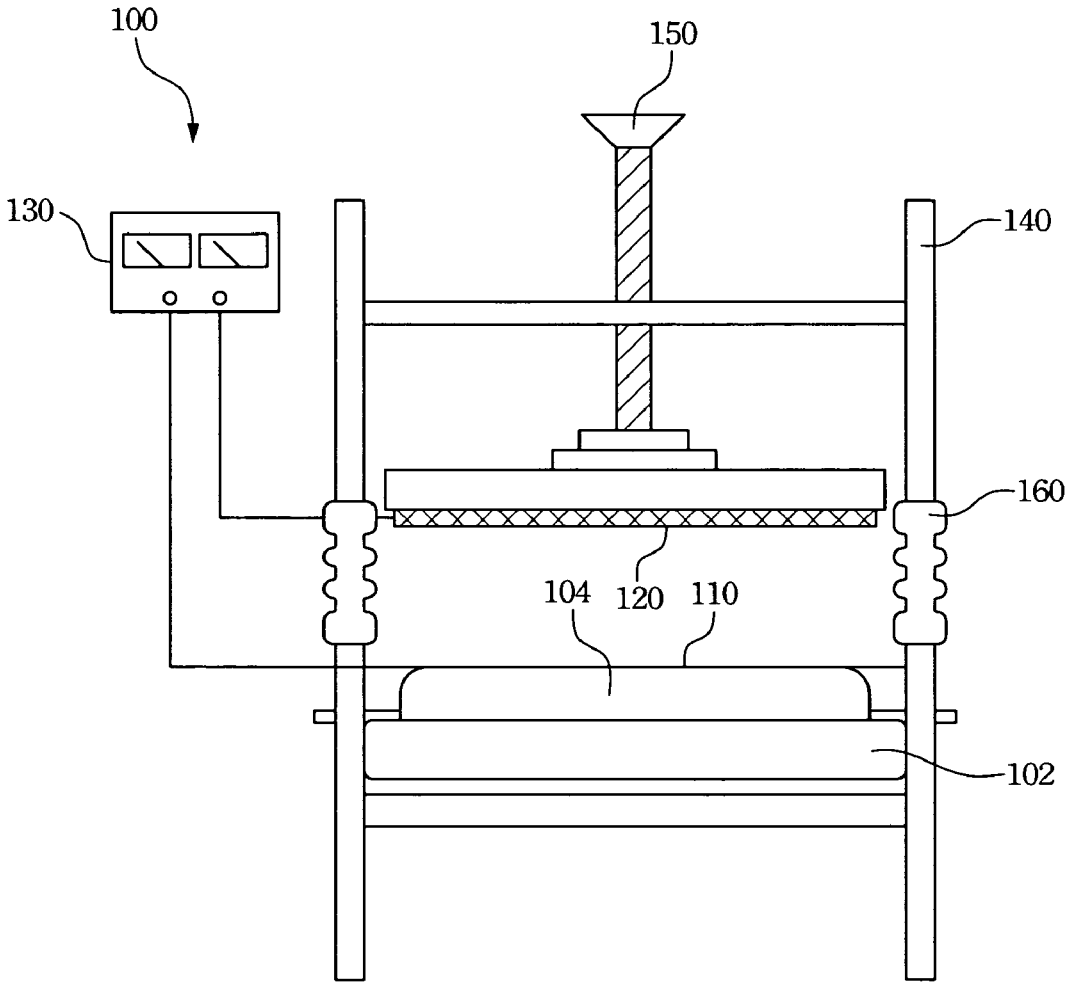
FIG. 1 is a schematic diagram of an embodiment of an electrostatic spinning apparatus of the invention.

Reference will now be made in detail to the present preferred embodiments of the invention, examples of which are illustrated in the accompanying drawings. Wherever possible, the same reference numbers are used in the drawings and the description to refer to the same or like parts.

Refer to FIG. 1. FIG. 1 illustrates a schematic diagram of an embodiment of an electrostatic spinning apparatus of the invention. The electrostatic spinning apparatus 100 includes a feeding device, at least one linear electrode 110, at least one collecting electrode 120, a high-voltage power supply 130, and a frame 140. The feeding device includes a tank 102 disposed on the frame 140 and a roller 104. The two ends of the roller 104 are fixed on the frame 140. The tank 102 may be utilized to contain an electrostatic spinning solution and the roller 104 may be rolled in the tank 102. The linear electrode 110 is contacted with the roller 104 to absorb the electrostatic spinning solution onto the linear electrode 110, wherein the linear electrode 110 is used as a spinning electrode of the electrostatic spinning apparatus. The collecting electrode 120 is disposed equidistantly to the linear electrode 110. For example, the surface of the collecting electrode 120 and the surface of the linear electrode 110 are facing each other and also parallel to each other so the distance between the collecting electrode 120 and the linear electrode 110 is constant. The high-voltage power supply 130 is connected with the linear electrode 110 and the collecting electrode 120 to oppositely charge the linear electrode 110 and the collecting electrode 120.

In this embodiment, the linear electrode 110 is charged positively and the collecting electrode 120 is charged negatively by the high-voltage power supply 130. The linear electrode 110 may contact with the roller 104 to coat the electrostatic spinning solution contained in the tank 102 through the roller 104 rolled in the tank 102. The electrostatic spinning solution on the linear electrode 110 is repelled by the high-voltage like charge and may be departed from the roller 104 and then scattered. The positively charged electrostatic spinning solution may be attracted by the collecting electrode 120 charged negatively and the electrostatic spinning solution may be led to the collecting electrode 120 and formed an electrostatic spinning fiber.

The electrostatic spinning apparatus 100 may have a height controller 150 disposed on the frame 140 and connected to the collecting electrode 120. The distance between the linear electrode 110 and the collecting electrode 120 can be adjusted by the height controller 150. The electrostatic spinning apparatus 100 may also include a plurality of high-voltage insulators 160 disposed between the linear electrode 110 and the collecting electrode 120 to prevent electric leakage while performing electrostatic spinning. The intensity of the electric field of the electrostatic spinning apparatus 100 may be adjusted by the high-voltage power supply 130 and the height controller 150. The shorter distance between the linear electrode 110 and the collecting electrode 120; the stronger electric field between the linear electrode 110 and the collecting electrode 120; The higher voltage provided by the high-voltage power supply 130; the stronger electric field between the linear electrode 110 and the collecting electrode 120.

The material of the frame 140 may be bakelite. The material of the roller 104 may be an insulating material, such as rubber. The material of the linear electrode 110 and the collecting electrode 120 may be metal. The linear electrode 110 may have a curved surface or a saw-toothed surface. The diameter of the linear electrode 110 may be about 0.1 mm to 3 mm. The diameter of the linear electrode 110 may be 0.2 mm to 1 mm. The diameter of the linear electrode 110 is about 0.8 mm. The voltage provided by the high-voltage power supply 130 is about 75 KV.

Comparing to the traditional electrostatic spinning technique using spinneret, the linear electrode 110 may have larger surface area that may produce more electrostatic spinning fibers. The linear electrode 110 is easily cleaned when changing electrostatic spinning solution. The electrostatic spinning apparatus 100 of the invention may increase the yield of electrostatic spinning fibers and may simplify the process of changing electrostatic spinning solution.

Figure 2A:
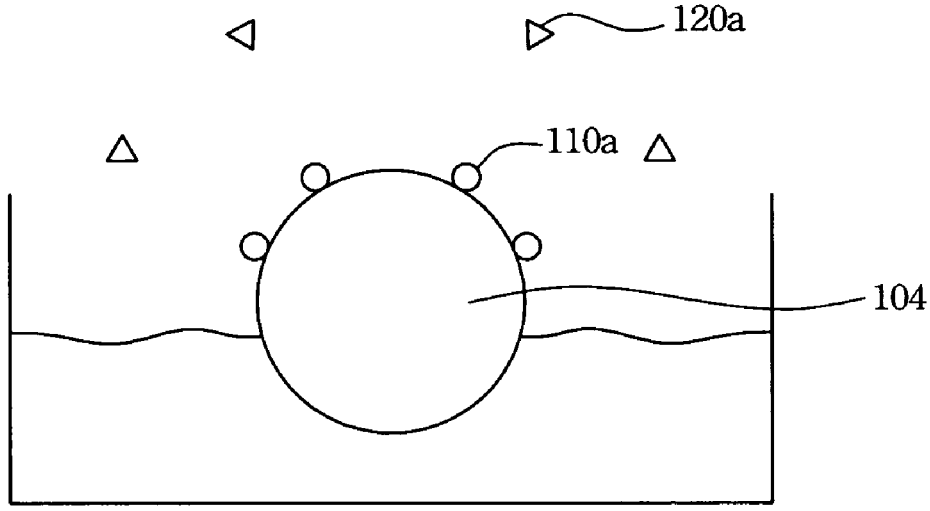
FIG. 2A to FIG. 2F are schematic diagrams of another embodiment of linear electrode and collecting electrode of the electrostatic spinning apparatus of the invention.
Figure 2B:
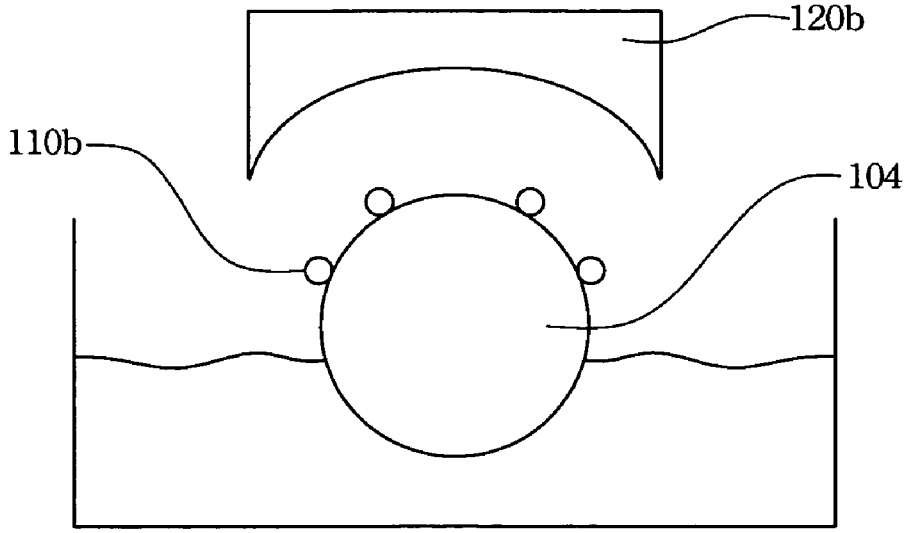

Refer to FIG. 2A to FIG. 2F. FIG. 2A to FIG. 2F are schematic diagrams of another embodiment of linear electrode and collecting electrode of the electrostatic spinning apparatus of the invention. In FIG. 2A, the roller 104 is contacted with a plurality of the linear electrode 110*a*. There is also a plurality of collecting electrodes 120*a* and each of the collecting electrodes 120*a* is corresponding to one linear electrode 110*a*. The shape of the collecting electrodes 120*a* may be linear. The collecting electrodes 120*a* are disposed equidistantly to linear electrodes 110*a*, thus the collecting electrodes 120*a* may be curve-shaped. In FIG. 2B, the roller 104 is contacted with a plurality of linear electrodes 110*b*; the corresponding collecting electrode 120*b* is arc-shaped to keep a constant distance between the linear electrodes 110*b* and the collecting electrode 120*b*.

Figure 2C:
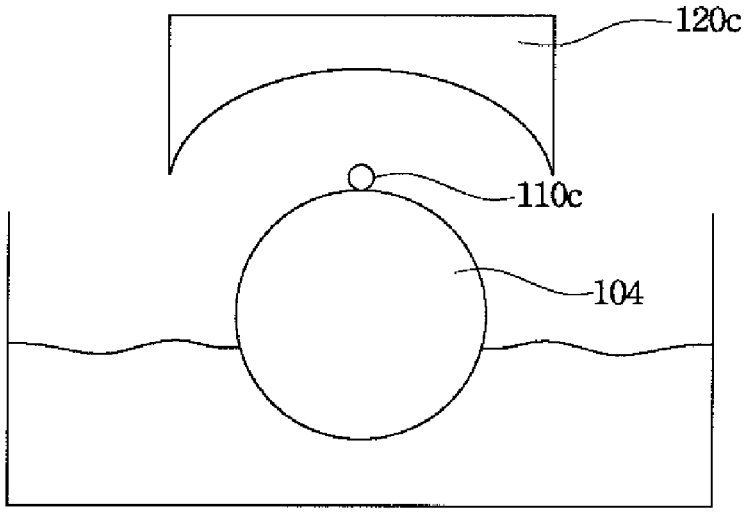
Figure 2D:
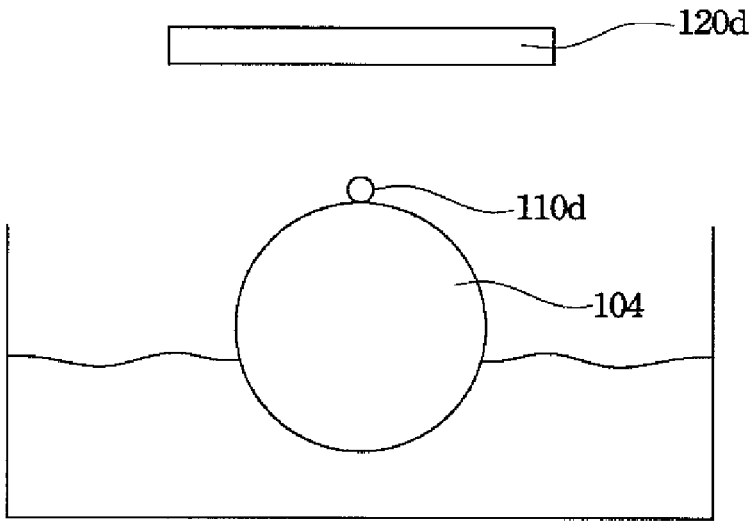
Figure 2E:
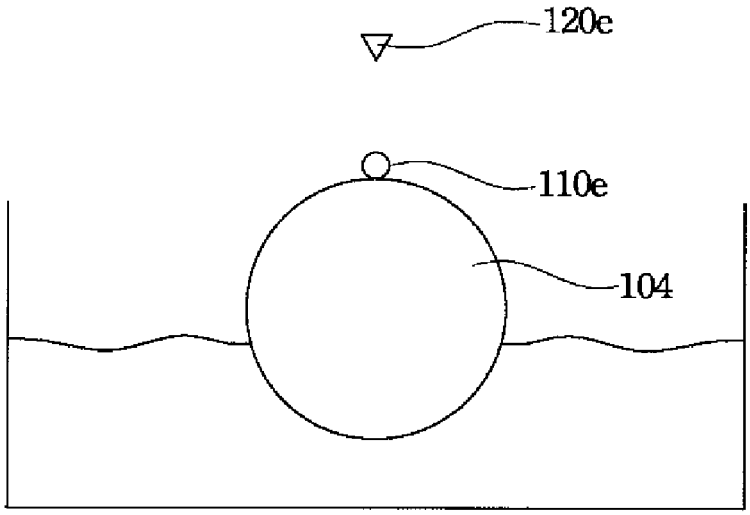
Figure 2F:
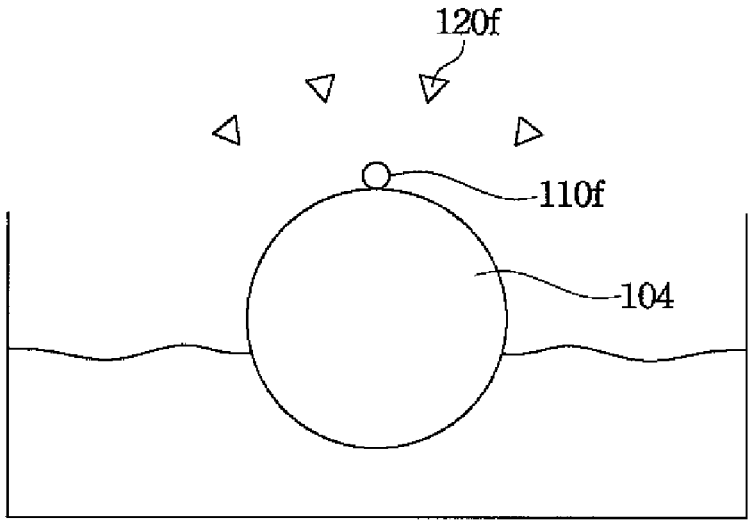
Figure 3A:
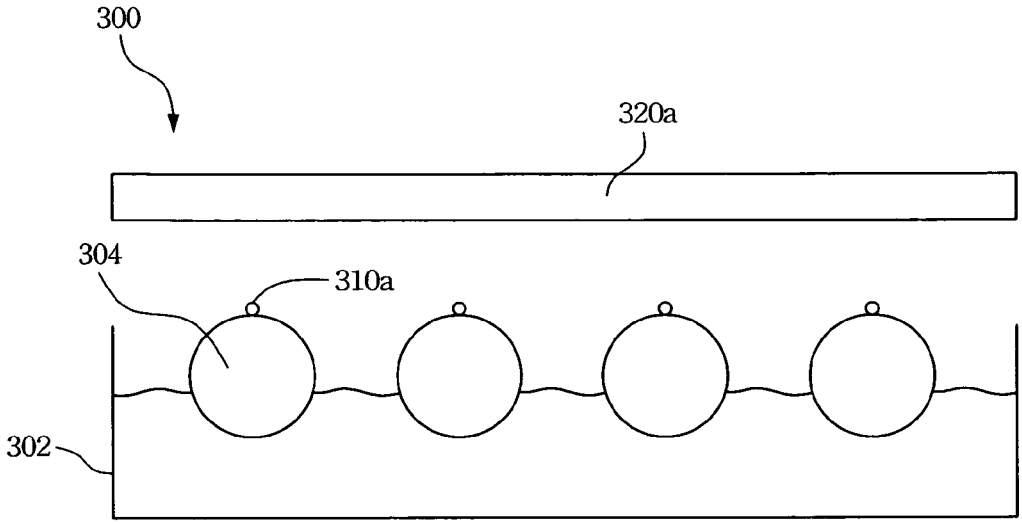
FIG. 3A and FIG. 3B are schematic diagrams of another embodiment of linear electrode and collecting electrode of the electrostatic spinning apparatus of the invention.
Figure 3B:
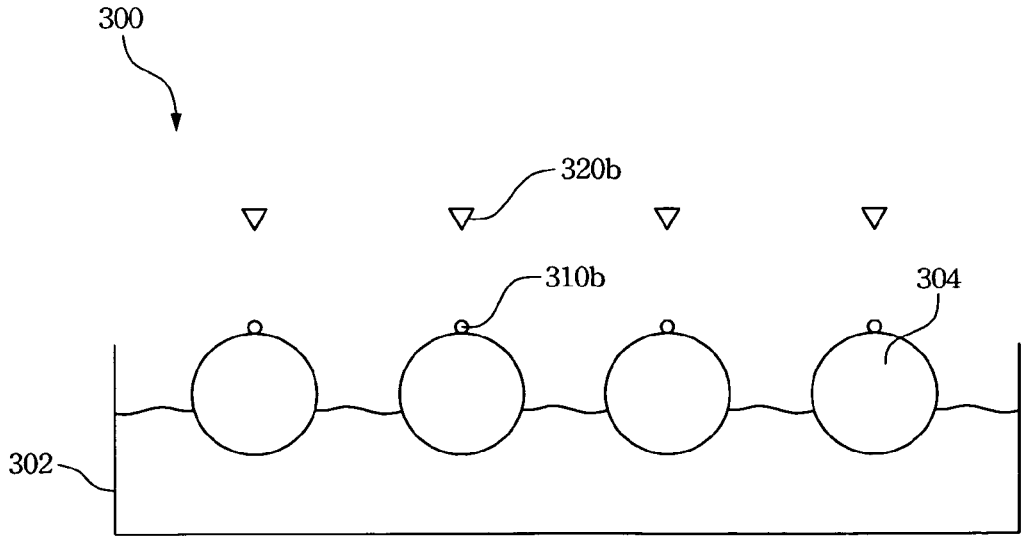

In FIG. 2C, the roller 104 is contacted with one linear electrode 110*c*, and the corresponding collecting electrode 120*c* is arc-shaped. In FIG. 2D, the roller 104 is contacted with one linear electrode 110*d*, and the corresponding collecting electrode 120*d* is plate-shaped. In FIG. 2E, the roller 104 is contacted with one linear electrode 110*e*, and the shape of the corresponding collecting electrode 120*e* is linear. In FIG. 2F, the roller 104 is contacted with one linear electrode. The shape of the corresponding collecting electrodes 120*f* is linear and the collecting electrodes 120*f* are formed as a curve. The linear electrodes 110 and the collecting electrodes 120 may be disposed equidistantly but not limited by the above embodiment Refer to FIG. 3A and FIG. 3B. FIG. 3A and FIG. 3B are schematic diagrams of another embodiment of linear electrode and collecting electrode of the electrostatic spinning apparatus of the invention. The feeding device of the electrostatic spinning apparatus 300 may include a tank 302 and a plurality of the rollers 304 to highly improve the yield of the electrostatic spinning fibers.

In FIG. 3A, each roller 304 is contacted with one linear electrode 310*a*, and each corresponding collecting electrode 320*a* is plate-shaped. Each collecting electrode 320*a* is disposed equidistantly to each corresponding linear electrode 310*a*. In FIG. 3B, each roller 304 is contacted with one linear electrode 310*b*, and the shape of each corresponding collecting electrode 320*b* is linear. Each collecting electrode 320*b* is disposed equidistantly to each corresponding linear electrode 310*b*.

Figure 4:
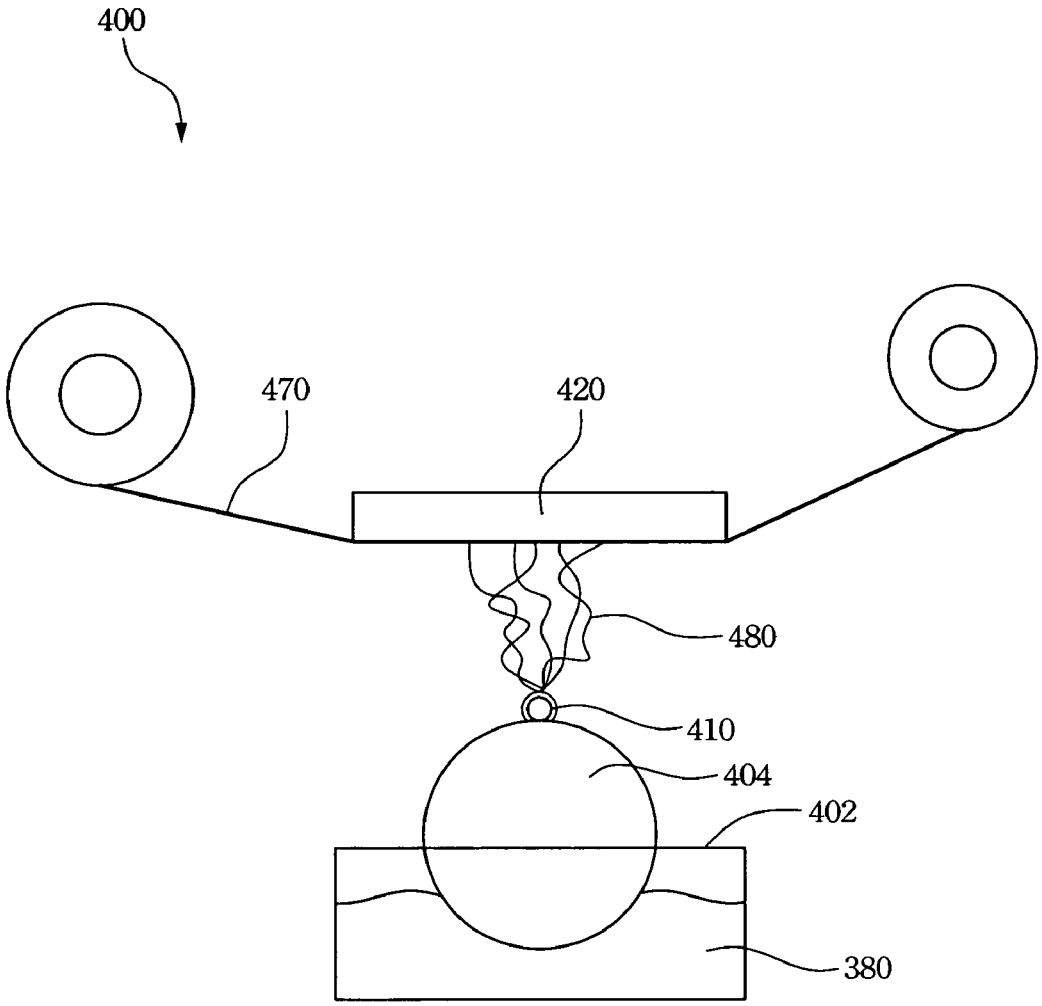
FIG. 4 is a schematic diagram of another embodiment of the electrostatic spinning apparatus of the invention.

Refer to FIG. 4. FIG. 4 is a schematic diagram of another embodiment of the electrostatic spinning apparatus of the invention. The electrostatic spinning apparatus 400 may further comprise a conveyer belt 470 disposed between the collecting electrode 420 and the linear electrode 410, the conveyer belt 470 may be contacted with the surface of the collecting electrode 420 facing the linear electrode 410. The electrostatic spinning solution 380 in the tank 402 may be coated onto the linear electrode 410 through the roller 404, and the electrostatic spinning solution 380 may be charged positively. The charged electrostatic spinning solution 380 may be departed from the roller 404 and then scattered because like charges repel. The positive charged electrostatic spinning solution 480 may be attracted by the collecting electrode 420 charged negatively and the electrostatic spinning solution 480 may be led to the conveyer belt 470 on the surface of the collecting electrode 420 and formed the electrostatic spinning fibers. The conveyer belt 470 may have a conveying direction and may collect and convey the electrostatic spinning fibers. There might have a fabric on the conveyer belt 470 and the electrostatic spinning fibers may cover the fabric to form a composite fabric.

According to the above embodiment, the electrostatic spinning apparatus of the invention may utilize the linear electrode to substitute conventional spinneret, then the block of the spinneret or the pipe may be prevented. The linear electrode of the electrostatic spinning apparatus can be changed when repairing electrostatic spinning apparatus is repaired or changing electrostatic spinning solution. The electrostatic spinning apparatus may use the linear electrode and the roller to spin the electrostatic spinning solution with no need of carving roller surface. The electrostatic spinning apparatus may have one or more linear electrodes to meet the requirement of different products.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electrostatic spinning apparatus comprising:

a feeding device comprising a tank and a roller, wherein an electrostatic spinning solution is contained in the tank and the roller is rolled in the tank;

at least one linear electrode contacted with the roller to coat the electrostatic spinning solution onto at least one linear electrode;

at least one collecting electrode disposed equidistantly to the least one linear electrode; and a high-voltage power supply connected with the linear electrode and the collecting electrode to oppositely charge the linear electrode and the collecting electrode, wherein the electrostatic spinning solution is led to the collecting electrode from the linear electrode and formed an electrostatic spinning fiber.

2. The electrostatic spinning apparatus of claim 1, wherein the linear electrode is a plurality of the linear electrodes.

3. The electrostatic spinning apparatus of claim 2, wherein the collecting electrodes are as many as the linear electrodes.

4. The electrostatic spinning apparatus of claim 2, wherein the number of the collecting electrode is more than one, and a shape of each collecting electrode is linear.

5. The electrostatic spinning apparatus of claim 2, wherein each collecting electrode is arc-shaped.

6. The electrostatic spinning apparatus of claim 1, wherein the number of the linear electrode is one.

7. The electrostatic spinning apparatus of claim 6, wherein each collecting electrode is plate-shaped.

8. The electrostatic spinning apparatus of claim 6, wherein the number of the collecting electrode is one, and the collecting electrode is arc-shaped.

9. The electrostatic spinning apparatus of claim 6, wherein the shape of each collecting electrode is linear.

10. The electrostatic spinning apparatus of claim 1, wherein each linear electrode has a saw-toothed surface.

11. The electrostatic spinning apparatus of claim 1, wherein each linear electrode has a curved surface.

12. The electrostatic spinning apparatus of claim 1, wherein the diameter of each linear electrode is about 0.1 mm to 3 mm.

13. The electrostatic spinning apparatus of claim 12, wherein the diameter of the linear electrode is about 0.2 mm to 1 mm.

14. The electrostatic spinning apparatus of claim 1, wherein the electrostatic spinning apparatus comprises a plurality of high-voltage insulators disposed between the linear electrode and the collecting electrode to prevent electric leakage.

15. The electrostatic spinning apparatus of claim 1, wherein the electrostatic spinning apparatus comprises a height controller disposed on the frame and connected to the collecting electrode.

16. The electrostatic spinning apparatus of claim 1, wherein the electrostatic spinning apparatus comprises a conveyer belt disposed between the collecting electrode and the linear electrode and the conveyer belt is contacted with a surface of the collecting electrode facing the linear electrode.

17. The electrostatic spinning apparatus of claim 16, wherein the conveyer belt further comprises a fabric positioned on the conveyer belt and the electrostatic spinning fiber is covered on the fabric to form a composite fabric.

18. The electrostatic spinning apparatus of claim 1, wherein a material of the roller is an insulating material.

19. An electrostatic spinning apparatus comprising:

a tank for containing an electrostatic spinning solution;

a plurality of rollers rolled in the tank;

a plurality of linear electrodes and each of the linear electrode is contacted with one of the rollers to coat the electrostatic spinning solution onto the linear electrodes;

at least one collecting electrode disposed equidistantly to the linear electrodes; and a high-voltage power supply connected with the linear electrode and the collecting electrode to oppositely charge the linear electrodes and the collecting electrode, wherein the electrostatic spinning solution is led to the collecting electrode from the linear electrode and formed an electrostatic spinning fiber.

20. The electrostatic spinning apparatus of claim 19, wherein each collecting electrode is a plate-shaped.

21. The electrostatic spinning apparatus of claim 19, wherein the number of the collecting electrode is more than one, and the shape of each collecting electrode is linear.

22. The electrostatic spinning apparatus of claim 19, wherein each linear electrode has a saw-toothed surface.

23. The electrostatic spinning apparatus of claim 19, wherein each linear electrode has a curved surface.

24. The electrostatic spinning apparatus of claim 19, wherein the diameter of each linear electrode is about 0.1 mm to 3 mm.

25. The electrostatic spinning apparatus of claim 24, wherein the diameter of the linear electrode is about 0.2 mm to 1 mm.

26. The electrostatic spinning apparatus of claim 19, wherein the electrostatic spinning apparatus comprises a plurality of high-voltage insulators disposed between the linear electrode and the collecting electrode to prevent electric leakage.

27. The electrostatic spinning apparatus of claim 19, wherein the electrostatic spinning apparatus comprises a height controller disposed on the frame and connected to the collecting electrode.

28. The electrostatic spinning apparatus of claim 19, wherein the electrostatic spinning apparatus comprises a conveyer belt disposed between the collecting electrode and the linear electrode and the conveyer belt is contacted with the surface of the collecting electrode facing the linear electrode.

29. The electrostatic spinning apparatus of claim 28, wherein the conveyer belt further comprises a fabric positioned on the conveyer belt and the electrostatic spinning fiber is covered on the fabric to form a composite fabric.

30. The electrostatic spinning apparatus of claim 19, wherein a material of the roller is an insulating material.

* * * * *